US007303371B2

(12) United States Patent
Tiemann, legally incapacitated

(10) Patent No.: US 7,303,371 B2
(45) Date of Patent: Dec. 4, 2007

(54) GAS TURBINE HAVING A SEALING ELEMENT BETWEEN THE VANE RING AND A VANE CARRIER OF THE TURBINE

(75) Inventor: Peter Tiemann, legally incapacitated, Witten (DE); by Iris Oltmanns, legal representative, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 23 days.

(21) Appl. No.: 10/567,667

(22) PCT Filed: Jul. 5, 2004

(86) PCT No.: PCT/EP2004/007333

§ 371 (c)(1),
(2), (4) Date: Feb. 9, 2006

(87) PCT Pub. No.: WO2005/019602

PCT Pub. Date: Mar. 3, 2005

(65) Prior Publication Data

US 2006/0245915 A1 Nov. 2, 2006

(30) Foreign Application Priority Data

Aug. 11, 2003 (EP) ..... 03018240

(51) Int. Cl.
*F01D 11/00* (2006.01)

(52) U.S. Cl. ..... 415/191; 415/209.3

(58) Field of Classification Search ..... 415/199.1, 415/199.2, 209.2, 209.3, 213.1
See application file for complete search history.

(56) References Cited

U.S. PATENT DOCUMENTS

| | | | | |
|---|---|---|---|---|
| 4,379,560 | A | 4/1983 | Bakken | |
| 4,425,078 | A | 1/1984 | Robbins | |
| 4,889,469 | A * | 12/1989 | Wilkinson | 415/191 |
| 5,609,469 | A | 3/1997 | Worley et al. | |
| 5,785,499 | A | 7/1998 | Houston et al. | |
| 5,833,244 | A | 11/1998 | Salt et al. | |
| 6,164,656 | A | 12/2000 | Frost | |
| 6,273,683 | B1 | 8/2001 | Zagar et al. | |
| 6,682,300 | B2 * | 1/2004 | Bolms | 415/173.3 |
| 6,702,549 | B2 * | 3/2004 | Tiemann | 415/135 |
| 7,040,857 | B2 * | 5/2006 | Chiu et al. | 415/1 |
| 7,094,025 | B2 * | 8/2006 | Arness et al. | 415/189 |

* cited by examiner

*Primary Examiner*—Ninh H. Nguyen

(57) ABSTRACT

The invention relates to a gas turbine. The aim of the invention is to provide an axial sealing between a vane ring and a moving blade ring, which has an excellent sealing effect, is easy to install and inexpensive to produce. For this purpose, a sealing element is used that extends across at least a fourth of the hot gas channel circumference. Preferably, said sealing element extends across approximately half the circumference and is inserted in grooves of the vane support and the vane platforms.

9 Claims, 3 Drawing Sheets

GAS TURBINE HAVING A SEALING ELEMENT BETWEEN THE VANE RING AND A VANE CARRIER OF THE TURBINE

CROSS REFERENCE TO RELATED APPLICATIONS

This application is the U.S. National Stage of International Application No. PCT/EP2004/007333, filed Jul. 5, 2004 and claims the benefit thereof. The International Application claims the benefits of European Patent application No. 03018240.6 EP filed Aug. 11, 2003. All of the applications are incorporated by reference herein in their entirety.

FIELD OF THE INVENTION

The invention relates to an axial gas turbine, in which guide vane rings and rotor blade rings follow one another in the axial direction in the hot-gas duct. These blade/vane rings are acted on by cooling air from various pressure levels. A sealing element is provided for forming a seal between the individual pressure levels.

BACKGROUND OF THE INVENTION

An axial gas turbine comprises a compressor, a combustion chamber and a turbine part. In the compressor, combustion air is highly compressed, and this highly compressed combustion air is then burnt with fuel in the combustion chamber. The hot gas which is formed is passed through a hot-gas duct in the turbine part. Guide vane rings and rotor blade rings follow one another alternately in the turbine part. Guide vanes and rotor blades are arranged adjacent to one another in the circumferential direction in each of these blade/vane rings.

The temperatures in a gas turbine of this type may reach levels which exceed the melting points of the materials that can be used and/or reduce the hot strength of the materials to an unacceptable extent. For this reason, the components in the hot-gas duct are often cooled with a cooling medium. For this purpose air is generally branched off from the compressor to act as cooling air. The demand for cooling drops along the direction of flow in the hot-gas duct. For this reason, cooling air at a lower pressure level than cooling air for front turbine stages is sufficient to cool rear turbine stages. To minimize the consumption of cooling air, since it reduces the efficiency of the gas turbine, the axially different turbine stages, i.e. the different blade/vane rings, are acted on by cooling air from different pressure levels. Blade/vane rings which lie further forward in the direction of flow are supplied with compressed air at a higher pressure than blade/vane rings lying further to the rear in the direction of flow.

In view of this different supply of cooling air even to blade/vane rings positioned next to one another, it is necessary to form a seal between the different pressure levels. A seal is also required in order to prevent hot gas from being mixed into the cooling air and therefore to prevent a reduced cooling action.

U.S. Pat. No. 5,833,244 shows a gas turbine sealing arrangement. The sealing of two adjacent blade/vane rings is in this case achieved by a labyrinth sealing system. Individual sealing elements are arranged in grooves of rotor disks. These sealing segments have tooth-like elevations which run transversely to the direction of flow, are arranged in succession in the axial direction and are arranged opposite a guide vane tip. Arranging these segments next to one another in the circumferential direction provides a labyrinth sealing system which runs all the way around the circumferential direction and is in particular also suitable for sealing in large gas turbines.

The sealing system located between two blade/vane rings in the axial direction is distinct from a sealing arrangement which acts in the circumferential direction between blades/vanes of a single blade/vane ring. A circumferential seal of the latter type is used to shield the hot gas flowing in the hot-gas duct from the rotor discs or guide vane carriers. Arrangements of this type are disclosed, for example, in U.S. Pat. No. 5,785,499 or U.S. Pat. No. 6,273,683.

SUMMARY OF THE INVENTION

It is an object of the invention to provide a sealing system for forming a seal between two blade/vane rings of a gas turbine which are at different pressure levels, the sealing system having a particularly good sealing action and at the same time being simple to install and inexpensive.

According to the invention, this object is achieved by an axial gas turbine directed along a turbine axis and comprising a compressor, a combustion chamber and a turbine part, with guide vane rings and rotor blade rings being arranged in axial succession in a hot-gas duct in the turbine part, a hot gas flowing through the hot-gas duct in operation, and the guide vane rings and rotor blade rings being cooled by cooling air, the pressure level of which decreases in the direction of flow of the hot gas, wherein a sealing element, which seals off the different pressure levels with respect to one another and extends as a single piece around at least a quarter of a circle running perpendicularly on the turbine axis as its center point, is arranged between at least one guide vane ring and a directly adjacent rotor blade ring.

Therefore, the invention for the first time adopts the route of enabling a sealing element to extend over a great circumferential distance in order to form a seal in the axial direction. This considerably improves the sealing action, since sealing boundaries running in the circumferential direction are reduced. Furthermore, the reduction in the number of components facilitates installation. The reduction in the number of components also produces a less expensive design.

It is preferable for the sealing element to extend over half the circle. Consequently, only two sealing elements are required for each stage that is to be sealed off. In the case of a gas turbine casing which comprises two halves engaging in one another at a joint, the sealing elements are preferably arranged in such a way that in each case one sealing element extends along one of the two housing halves. This in particular also facilitates dismantling or exchange in the event of servicing being carried out on the gas turbine.

Preferably, the sealing element is formed as an annular metal sheet with a surface extending in the radial direction and having an outer edge and an inner edge. An annular metal sheet of this type is particularly simple to produce in manufacturing technology terms.

Also preferably, the outer edge is arranged in respectively corresponding platform grooves, which in the side remote from the hot-gas duct of a respective platform of guide vanes of the guide vane ring or of a guide ring located radially outside the rotor blade ring, and the outer edge is arranged in a carrier groove running within a guide vane carrier. Guide vanes have a main blade part adjoined by a platform. This platform is used to shield the guide vane carrier from the hot gas. The platform is adjoined by a securing device, by which the guide vane is secured in the guide vane carrier.

A guide vane ring is axially adjoined by a rotor blade ring, which on the rotor side likewise routes the hot gas by means of platforms on the rotor blades. That surface of the hot-gas duct which is adjacent to the guide vane carrier is shielded from the hot gas by guide rings located opposite the rotating blade tips of the rotor blades. The outer edge of the annular metal sealing sheet can be guided by grooves in the guide vanes of a guide vane ring. The outer edge is guided in a carrier groove running within the guide vane carrier.

Therefore, to install the sealing element, it is merely necessary for it to be inserted into the abovementioned grooves or for the sealing element to be placed into the guide vane carrier groove and then the guide vanes are fitted in such a way that the sealing element comes to lie in the platform grooves.

Preferably, the sealing element is clamped using a screw which presses on its surface and presses the sealing element onto the opposite platform groove side wall and carrier groove side wall. This active fitting of the sealing element results in reliable sealing which is independent of the operating state. It is also preferable for the sealing element to be clamped using a multiplicity of screws, preferably one screw per blade or vane of a blade/vane ring.

Guide vanes generally have a hooked formation, by means of which they are hooked into the guide vane carrier. A hooked formation of this type then defines an axial fixed point by means of an axial bearing surface between the hooked formation and the guide vane carrier. It is preferable for the sealing element to be arranged in the region of the axial fixed points. This position of the sealing element is advantageous in particular with the above-described active formation of the sealing element, since thermal displacements are at a low level in the region of the axial fixed point.

If an active formation is not selected for the sealing element, the sealing element is preferably arranged remote from the region of the axial fixed points. On account of the considerable temperature differences when stationary and in the operational state, this results in considerable thermally induced displacements of the vane platform or guide rings with respect to the guide vane carrier. The loose insertion of the sealing element into the platform or guide vane carrier grooves results in a passive formation here specifically on account of these thermal displacements. During the thermal displacement, the sealing element is pressed onto the groove walls in such a way that a reliable sealing is not achieved. Also preferably, in addition to the groove walls, a further projection running in the circumferential direction is arranged in the guide vane carrier as an axial bearing surface for the sealing element.

With the active formation of the sealing element described above, it is preferable first of all to complete the guide vane ring during assembly by installing the guide vanes, and thereafter to fit the adjacent guide rings.

BRIEF DESCRIPTION OF THE DRAWINGS

The invention is explained in more detail by way of example with reference to the drawings. Identical reference designations have the same meaning throughout the various figures.

In the drawing, in some cases diagrammatically and not to scale.

DETAILED DESCRIPTION OF THE INVENTION

Figure 1:
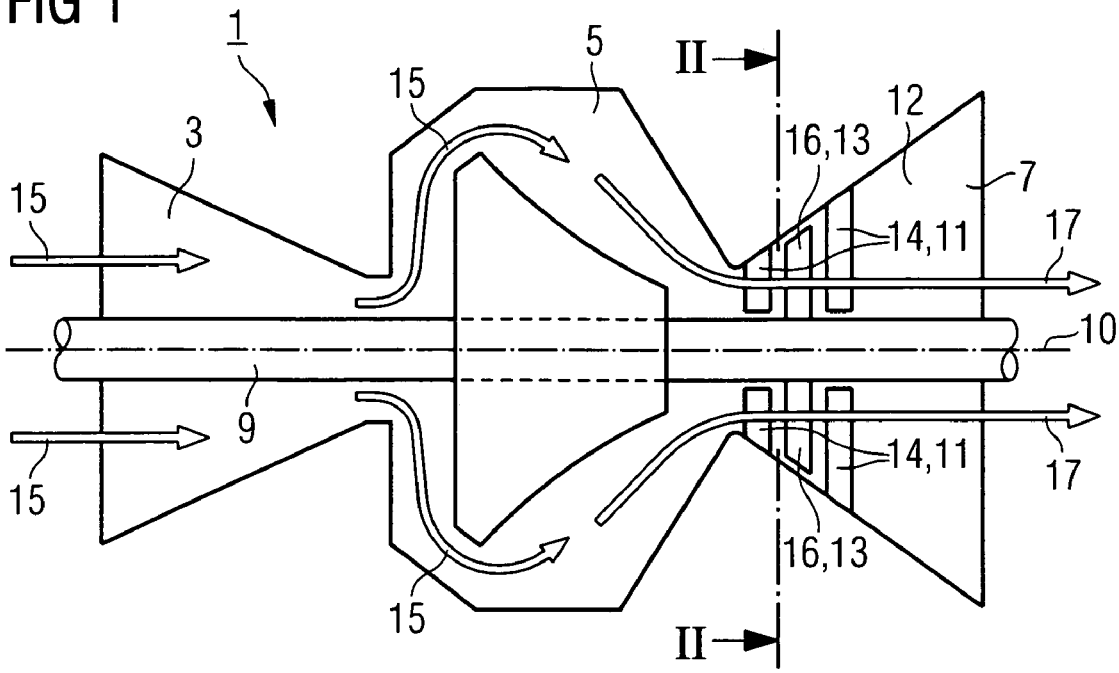
FIG. 1 shows a gas turbine.

FIG. 1 shows a gas turbine 1. In succession along a turbine axis 10, the gas turbine 1 has a compressor 3, a combustion chamber 5 and a turbine part 7. The compressor 3 and the turbine part 7 are arranged on a common shaft 9 extending along the turbine axis 10. A hot-gas duct 12 which widens conically runs within the turbine part 7. Guide vanes 11 and rotor blades 13 project into this hot-gas duct 12. A multiplicity of guide vanes 11 is arranged circumferentially adjacent in a guide vane ring 14. A multiplicity of rotor blades 13 are arranged circumferentially adjacent in a rotor blade ring 16. Guide vane rings 14 and rotor blade rings 16 alternate with one another in the hot-gas duct 12.

When the gas turbine 1 is operating, ambient air is sucked in by the compressor 3 and compressed to form compressor air 15. The compressor air 15 is fed to the combustion chamber 5, where it is burnt with a fuel to form a hot gas 17. The hot gas 17 flows through the hot-gas duct 12 and therefore flows passed the guide vanes 11 and the rotor blades 13. This sets the shaft 9 in rotation, since the rotor blades 13 take up kinetic energy from the hot gas 17 and transmit it to the shaft 9, to which they are fixedly connected. The energy obtained from the hot gas 17 in this way can, for example, be transmitted to a generator for power generation.

Figure 2:
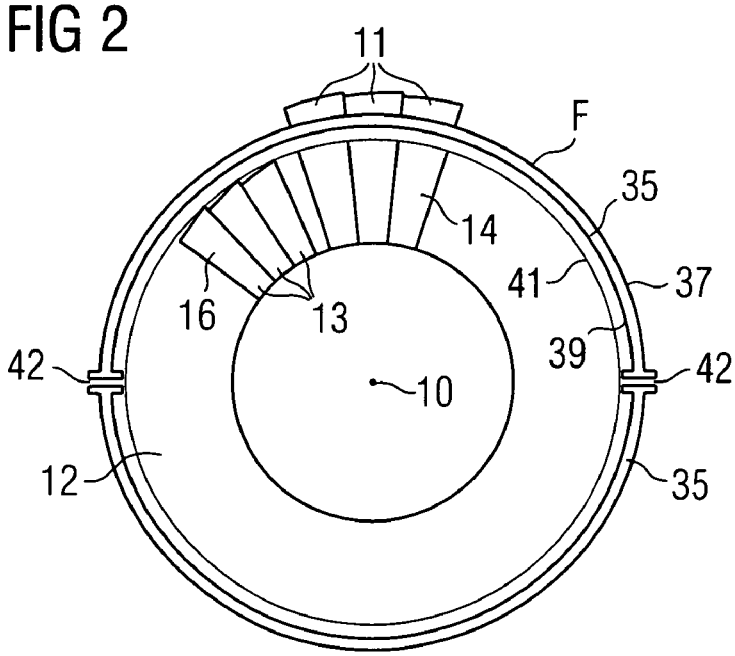
FIG. 2 shows a cross section through the turbine part of a gas turbine.

FIG. 2 shows a cross section through the hot-gas duct 12. Part of the rotor blade ring 16 and part of the guide vane ring 14 are illustrated. A sealing element 35, which is designed as an annular metal sheet, extends between the guide vane ring 14 and the rotor blade ring 16 in the circumferential direction over half of a circle 41 running perpendicular to the turbine axis 10. A sealing element 35 of the same type runs over the second half of the circle 41, so that the two sealing elements 35 form a continuous circle. The two sealing elements 35 meet one another at a joint 42. The joint 42 corresponds to a joint (not illustrated in more detail) dividing the gas turbine casing surrounding the hot-gas duct 12 in half. The sealing element 35 is in sheet-like form, with the figure showing a plane view onto the surface F. The surface F is delimited by an outer edge 37 and an inner edge 39 of the sealing element 35.

Figure 3:
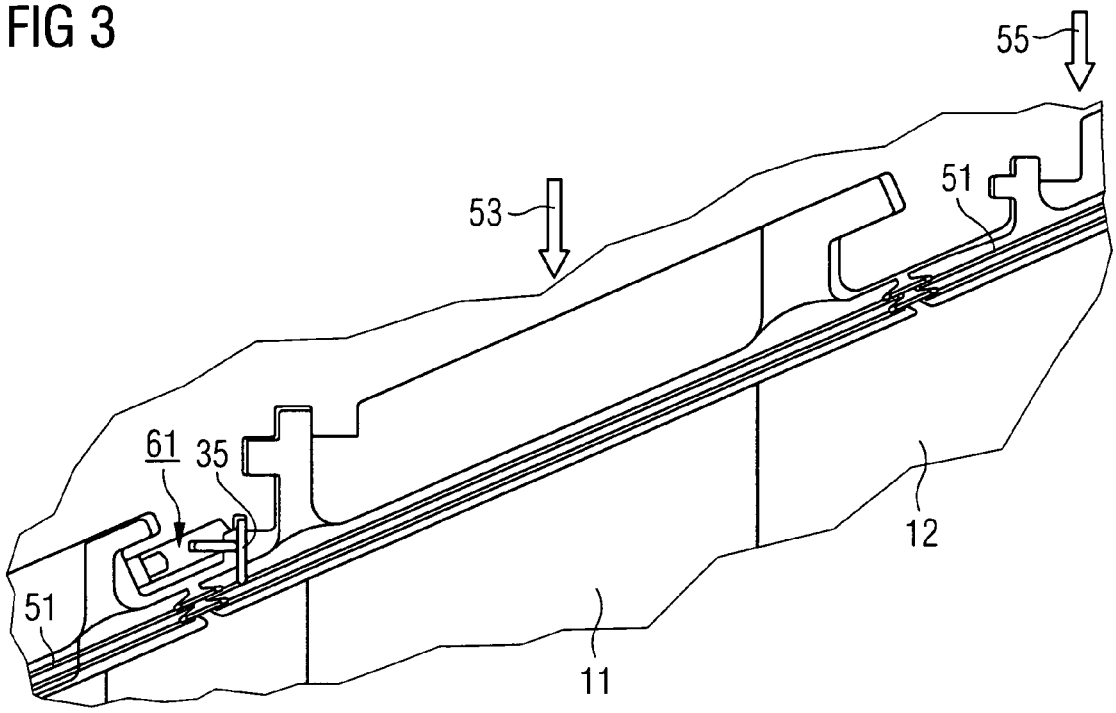
FIG. 3 shows an excerpt of a longitudinal section through the hot-gas duct of the gas turbine.

FIG. 3 shows an excerpt from a longitudinal section through the hot-gas duct 12. This excerpt illustrates a guide vane 11, which is enclosed by a guide ring 51 on both sides in the axial direction. A sealing element 35 is formed in accordance with FIG. 2. The precise arrangement is described with reference to FIG. 4. Cooling air from a first pressure level is fed to the guide vane 11. Cooling air 55 from a second pressure level is fed to the guide ring 51. The pressure level of the cooling air 53 is higher than that of the cooling air 55, since there is higher cooling demand for the guide vane 11 located further forward in the direction of flow of the hot gas 17 than for the guide vane 51 located further to the rear in the direction of flow. This axial graduation of the pressure level of cooling air is one reason why a seal is required between guide vane 11 and guide ring 51. Another reason is the need to reduce mixing of hot gas into the cooling air 53, 55 as much as possible, in order to avoid consequent heating of the cooling air and therefore reduced cooling capacity. The sealing element illustrated here is pressed onto axial surfaces by means of an active formation, resulting in the sealing action. This is explained in more detail with reference to FIG. 4.

Figure 4:
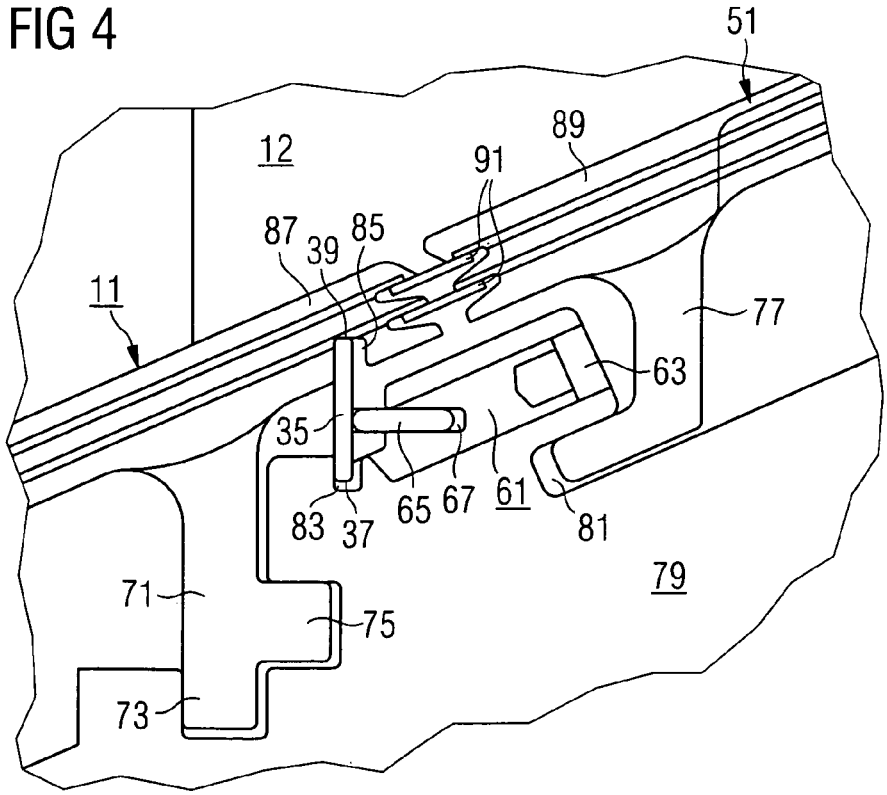
FIG. 4 shows an enlarged view with a sealing element from FIG. 3.

FIG. 4 shows an enlarged view of an excerpt from FIG. 3 comprising the sealing element 35. On the side remote from the hot gas, a groove 85 running in circumferential direction has been formed in a platform 87 of the guide vane 11. A guide vane carrier 79 lies opposite the guide vane 11 on the side remote from the hot-gas duct 12. A guide vane carrier groove 83 is also arranged running in the circumferential direction in the guide vane carrier 79, radially opposite the platform groove 85. The sealing element 35 is an annular sheet-metal strip designed as shown in FIG. 2, with its inner edge 37 engaging in the platform groove 85. The outer edge 39 of the sealing element 35 lies in the guide vane carrier groove 83. Furthermore, circumferential seals 91, which seal off the gap between the guide ring 51 and the platform 87 between in each case two guide vanes 11 of a guide vane ring, have been introduced between guide vane 11 and an adjacent guide vane 51.

By means of a pressure-exerting device 61, the sealing element 35 is pressed onto the side walls of the platform groove 85 on one side and of the guide vane carrier groove 83 on the other side. For this purpose, a pressure-exerting web 65, which is guided within a groove 67 in the pressure-exerting device 61, is pressed onto the sealing element 35 by means of a screw 63 approximately in the radial center of the sealing element 35.

The axial position of the sealing element 35 is selected to be in the region of a hooked formation 71 of the guide vane 11. This hooked formation 71 is used to fit the guide vane 11. This hooked formation 71 is also used to define an axial fixed point 73 by means of an axial pressure-exerting surface and a radial fixed point 75 by means of a radial stop face. Thermal expansions of the platform 87 of the guide vane 11 with respect to the guide vane carrier 79 are relatively slight in the region of the axial fixed point 73, so that by means of the active formation of the sealing element 35, a good sealing action is achieved irrespective of the operating state of the gas turbine. The guide ring 51 is likewise arranged in the guide vane carrier 79 by means of a hooked formation 77. In configurations according to the prior art, i.e. without the sealing element 35, it was often attempted to achieve axial sealing by means of the hooked formations 71 and 77. To do this, it was necessary to maintain relatively tight tolerances in order to minimize the gaps at the hooked formations 71, 77 in the guide vane carrier 79. This makes manufacture and assembly more difficult. The sealing element 35 now provides a simpler and less expensive yet reliably sealing way of forming an axial seal.

Figure 5:
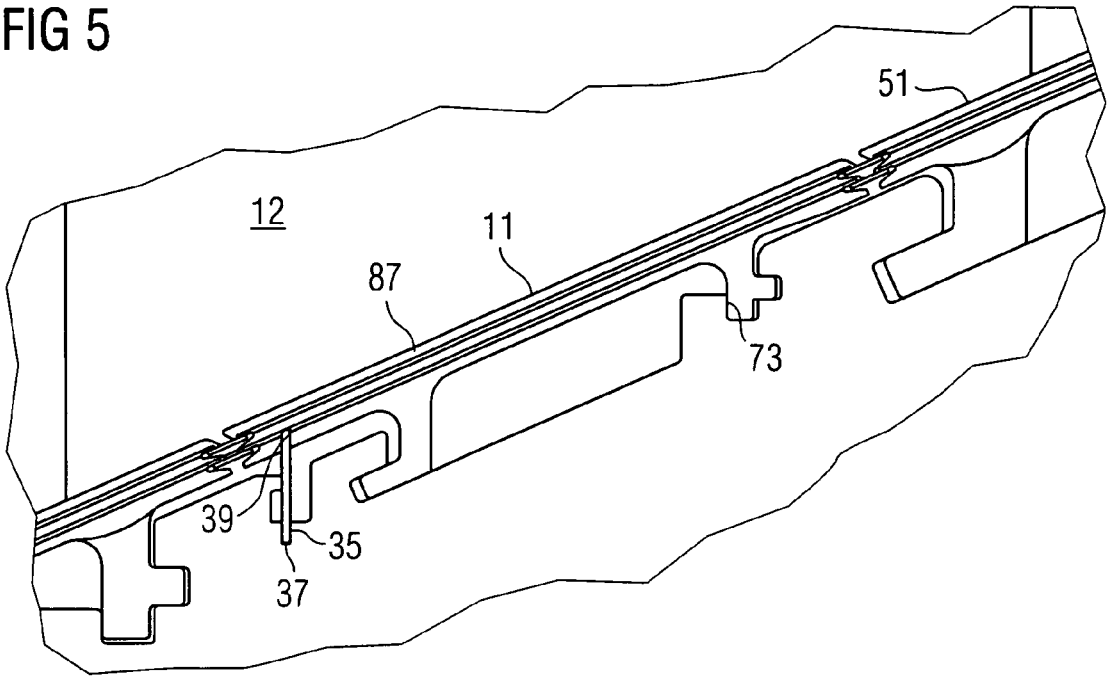
FIG. 5 shows a further excerpt from a longitudinal section through a gas turbine.

FIG. 5 shows a further excerpt from a longitudinal section through the hot-gas duct 12. The figure once again illustrate a guide vane 11, which is axially enclosed on both sides by guide rings 51. In this case, however, the sealing element 35 is arranged well away from the axial fixed point 73. Moreover, there is no device for pressing the sealing element 35 onto the groove walls. This is described in more detail with reference to FIG. 6.

Figure 6:
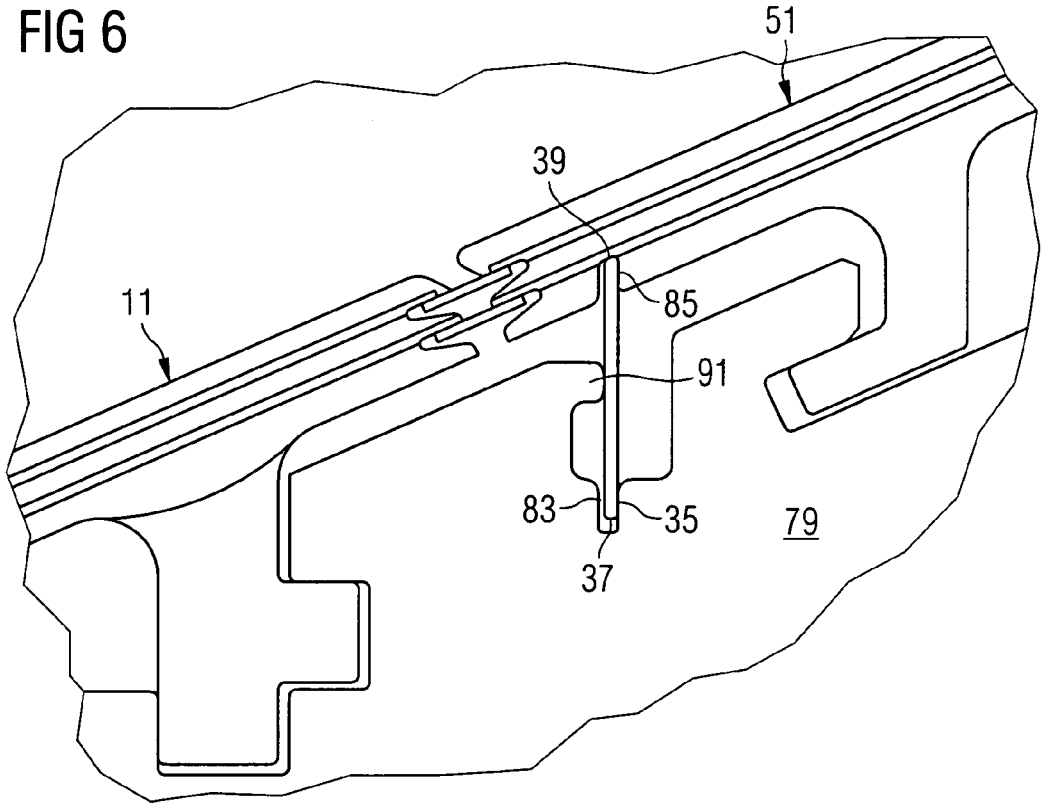
FIG. 6 shows an enlarged view incorporating a sealing element from FIG. 5.

FIG. 6 shows an excerpt encompassing the sealing element 35 from FIG. 5. As has already been described above, the sealing element 35 is once again arranged with its inner edge 39 in a platform groove 85 and with its outer edge 37 in a guide vane carrier groove 83. An additional shoulder 91 is formed in the guide vane carrier 79 as axial bearing surface, in such a way that it lies approximately in the region of the radial center of the sealing element 35. In the example shown here, the platform groove 85 is arranged in the guide ring 51. To avoid thermal stresses, the guide ring 51 can move with respect to the guide vane carrier 79. In operation, temperature differences lead to a displacement of the guide ring 51 with respect to the guide vane carrier 79. As a result, the sealing element 35 is bent and pressed onto the projection 91 in the guide vane carrier 79. This type of passive formation of the sealing element 35 leads to a good sealing action while at the same time requiring very little outlay on apparatus.

When assembling the gas turbine 1 or also when carrying out servicing work, the sealing element 35 is simply fitted into the guide vane carrier groove 83 and the guide vanes 11 or the guide rings 51 are mounted, depending on which of the components has the corresponding platform groove 85. Then, in each case either the guide vanes 11 or the guide rings 51 which adjoin the previously installed components are fitted.

The invention claimed is:

1. An axial flow gas turbine engine arranged about a central axis, comprising:

a compressor section;

a combustion chamber;

a turbine section having a plurality of guide vane rings and rotor blade rings arranged in axial succession in a hot-gas duct that contains a hot gas flow;

a cooling air flow for cooling the guide vane rings and the rotor blade rings, where the pressure of the cooling air flow decreases in the direction of the hot gas flow;

a guide vane carrier a flat sealing element arranged between a groove in the guide vane ring and a groove in the guide vane carrier which seals the different pressure levels associated with respective adjacent rings and extends as a single piece around at least a quarter of a circle concentric with the central axis of the engine; and means for urging the sealing element against the grooves in the guide vane ring and guide vane carrier and applying pressure against the middle of the sealing element so as to evenly apply the pressure to both the grooves.

2. The gas turbine as claimed in claim 1, wherein the sealing element extends half of the circle.

3. The gas turbine as claimed in claim 2, wherein the sealing element is formed as an annular metal sheet with a surface extending in the radial direction and having an outer and an inner edge.

4. The gas turbine as claimed in claim 3, wherein the sealing element inner edge is arranged in grooves within a guide vane ring that is located in the side furthest from the hot-gas duct and the outer edge is arranged in a carrier groove in the guide vane carrier, the guide vane carrier having a predetermined groove side wall.

5. The gas turbine as claimed in claim 4, wherein the sealing element is clamped to the groove side wall using a screw which presses the sealing element onto the opposite platform groove side wall and predetermined carrier groove side wall, the screw pressing against the middle of the sealing element on the surface thereof.

6. The gas turbine as claimed in claim 5, wherein the guide vanes each have an axial fixed point at which they are fixed against axial displacement in the guide vane carrier by a hooked formation, with the sealing element being arranged in the region of the axial fixed points.

7. The gas turbine as claimed in claim 3, wherein the guide vanes each have an axial fixed point at which they are fixed against axial displacement in the guide vane carrier by a hooked formation, with the sealing element being arranged opposite the region of the axial fixed points.

8. An axial flow gas turbine engine sealing system, comprising:

a guide vane ring having a groove;

a guide vane carrier having a groove;

a sealing element arranged between the guide vane ring and the guide vane carrier which seals the different pressure levels associated with the respective adjacent rings and extends as a single piece around at least a quarter of a circle concentric with the central axis of the engine and means for urging the sealing element against the grooves in the guide vane ring and guide vane carrier and applying pressure against the middle of the sealing element so as to evenly apply the pressure to both the grooves.

9. A semi-annular turbine blade and vane stage seal, comprising:

an inner seal edge arranged in a guide vane groove that is located distal a hot gas duct;

an outer seal edge arranged in a vane carrier groove;

a metallic seal sheet positioned within the grooves of the guide vane and vane carrier and having an arc length between 90° and 180 °;

wherein the stage seal isolates different cooling flow pressure levels associated with an adjacent stage; and means for urging the sealing element against the grooves in the guide vane ring and guide vane carrier and applying pressure against the middle of the sealing element so as to evenly apply the pressure to both the grooves.

* * * * *